US009974423B2

(12) United States Patent
Policicchio et al.

(10) Patent No.: US 9,974,423 B2
(45) **Date of Patent: *May 22, 2018**

(54) FLOOR CLEANING DEVICE HAVING A SOLE PLATE TO REMOVABLY RECEIVE A CLEANING SHEET THEREON

(71) Applicant: The Procter & Gamble Company, Cincinnati, OH (US)

(72) Inventors: Nicola John Policicchio, Mason, OH (US); Glenn Allen Bradbury, Mason, OH (US)

(73) Assignee: The Prcoter & Gamble Company, Cincinnati, OH (US)

( * ) Notice: Subject to any disclaimer, the term of this patent is extended or adjusted under 35 U.S.C. 154(b) by 1015 days.

This patent is subject to a terminal disclaimer.

(21) Appl. No.: 14/250,907

(22) Filed: Apr. 11, 2014

(65) Prior Publication Data

US 2014/0250619 A1 Sep. 11, 2014

Related U.S. Application Data

(63) Continuation-in-part of application No. 13/947,501, filed on Jul. 22, 2013, now Pat. No. 9,408,518, which (Continued)

(51) Int. Cl.

| | |
|---|---|
| ***A47L 11/40*** | (2006.01) |
| ***A47L 13/16*** | (2006.01) |
| ***A47L 11/33*** | (2006.01) |
| ***A47L 13/12*** | (2006.01) |
| ***A47L 13/20*** | (2006.01) |
| ***A47L 23/05*** | (2006.01) |

(52) U.S. Cl.

CPC ..... *A47L 13/16* (2013.01); *A47L 11/33* (2013.01); *A47L 11/4013* (2013.01); *A47L 11/4041* (2013.01); *A47L 11/4069* (2013.01); *A47L 11/4072* (2013.01); *A47L 13/12* (2013.01); *A47L 13/20* (2013.01); *A47L 23/05* (2013.01)

(58) Field of Classification Search

CPC ... A47L 11/33; A47L 11/4103; A47L 11/4069

USPC ..... 15/403, 52.1, 98

See application file for complete search history.

(56) References Cited

U.S. PATENT DOCUMENTS

| | | | |
|---|---|---|---|
| 9,783 | A | 6/1853 | Pusey |
| 306,008 | A | 9/1884 | Drew |

(Continued)

FOREIGN PATENT DOCUMENTS

| | | | |
|---|---|---|---|
| EP | 1027855 | A2 | 8/2000 |

OTHER PUBLICATIONS http://www.swiffer.com/products/swiffer-sweep-trap; Downloaded May 13, 2014; Swiffer Sweep & Trap with sheet attached enclosed; First delivery date Dec. 9, 2013.

*Primary Examiner* — Michael Jennings

(74) *Attorney, Agent, or Firm* — Larry L. Huston

(57) ABSTRACT

An implement for a cleaning system. The system has a floor cleaning device, which can accept a cleaning sheet removably attachable to the device. The device has a foot which comprises a housing and a panel movable in relationship to each other. The sheet is removably attachable to the panel, without requiring attachment to the housing. This arrangement provides ergonomic benefit and ease of sheet replacement. The cleaning system may be used to clean hard surfaces, such as a floor.

18 Claims, 8 Drawing Sheets

Related U.S. Application Data is a continuation-in-part of application No. 13/524,491, filed on Jun. 15, 2012, now Pat. No. 8,910,340.

(56) References Cited

U.S. PATENT DOCUMENTS

| | | | | |
|---|---|---|---|---|
| 329,257 | A | 10/1885 | Bissell | |
| 4,191,609 | A | 3/1980 | Trokhan | |
| 4,637,859 | A | 1/1987 | Trokhan | |
| 4,654,927 | A | 4/1987 | Novinger | |
| 4,709,436 | A | 12/1987 | Berfield et al. | |
| 5,208,935 | A | 5/1993 | Jailor et al. | |
| 5,960,508 | A | 10/1999 | Holt et al. | |
| 6,101,661 | A | 8/2000 | Policicchio et al. | |
| 6,305,046 | B1 | 10/2001 | Kingry et al. | |
| 6,386,392 | B1 | 5/2002 | Argentieri et al. | |
| 6,716,805 | B1 | 4/2004 | Sherry et al. | |
| 6,797,357 | B2 | 9/2004 | Fereshtehkhou et al. | |
| 6,845,538 | B2 | 1/2005 | Nakamura | |
| 6,936,330 | B2 | 8/2005 | Fereshtehkhou et al. | |
| 7,013,528 | B2 * | 3/2006 | Parker | A47L 5/28 15/364 |
| 7,134,161 | B2 | 11/2006 | Campos | |
| 7,144,173 | B2 | 12/2006 | Policicchio et al. | |
| 7,346,428 | B1 | 3/2008 | Huffman et al. | |
| D588,770 | S | 3/2009 | Koenig et al. | |
| 7,676,877 | B2 * | 3/2010 | Policicchio | A47L 11/33 15/41.1 |
| 8,020,236 | B2 | 9/2011 | Kaleta et al. | |
| 8,186,989 | B2 | 5/2012 | Yamaura et al. | |
| 9,408,516 | B2 * | 8/2016 | Bradbury | A47L 13/16 |
| 2004/0045126 | A1 * | 3/2004 | Parker | A47L 5/28 15/403 |
| 2005/0055792 | A1 | 3/2005 | Kisela et al. | |
| 2009/0077761 | A1 | 3/2009 | Kaleta et al. | |
| 2012/0096662 | A1 | 4/2012 | Uchiyama et al. | |
| 2012/0198644 | A1 | 8/2012 | Iles | |
| 2013/0333129 | A1 | 12/2013 | Willey et al. | |
| 2014/0026344 | A1 | 1/2014 | Willey et al. | |

* cited by examiner

FLOOR CLEANING DEVICE HAVING A SOLE PLATE TO REMOVABLY RECEIVE A CLEANING SHEET THEREON

FIELD OF THE INVENTION

The present invention relates to devices having a sheet usable to clean a floor or other hard surfaces and more particularly to such devices having a removably attachable sheet.

BACKGROUND OF THE INVENTION

Cleaning of hard surfaces, such as floors (vinyl, linoleum, tile, cement), countertops, showers, etc. is well known in the art. Cleaning may be accomplished using cellulosic paper towels and non-woven sheets, as are well known in the art. Nonwoven sheets may be made according to commonly assigned U.S. Pat. Nos. 6,936,330 and/or 6,797,357. Cellulosic paper towels may be made according to commonly assigned U.S. Pat. Nos. 4,191,609 and/or 4,637,859.

Such sheets have been removably attached to manual implements. The implements increase reach, and improve ergonomics. For example, when the hard surface to be cleaned is a floor, the implement allows the user to clean from a standing position, improving comfort over cleaning from a crouched position or on the knees. Manual implements may be made according to commonly assigned US 2012/0096662; U.S. Pat. Nos. 6,305,046 and/or D588,770.

One problem encountered when cleaning floors is that a user can encounter tacky soils, which tend to stick to the floor, and/or encounter a variety of fine soils, such as dust, granular soils, dried food debris, plants, mud, etc. which tend to stick to the floor less. To improve cleaning of soluble and tacky stains, wetted and wettable floor sheets have been used. Pre-wetted floor sheets include those having APG polymers, as disclosed in commonly assigned U.S. Pat. No. 6,716,805. Wettable floor sheets have been used with the commercially available Swiffer WetJet® device. This device sprays cleaning solution onto the floor from a replaceable reservoir, as described in commonly assigned U.S. Pat. No. 8,186,898. Cleaning solution chemistry and a reservoir therefor may be made according to commonly assigned U.S. Pat. No. 6,386,392. Floor sheets which absorb cleaning solution from the floor may be made according to commonly assigned U.S. Pat. Nos. 5,960,508, 6,101,661 and/or 7,144,173.

But these attempts do not always sufficiently clean the entire range of soils encountered, particularly large particles, such as cereal and chunks of mud from the floor. To overcome the problem of loose, large particle cleaning, rotatable beater bars have been utilized, as disclosed in U.S. Pat. No. 9,783, reissued Jun. 28, 1881; U.S. Pat. No. 306,008 issued Sep. 30, 1884; U.S. Pat. No. 329,257 issued Oct. 27, 1885; U.S. Pat. No. 4,654,927 issued Apr. 7, 1987; U.S. Pat. No. 7,134,161 issued Nov. 14, 2006. The beater bars in these teachings are driven by the wheels. Particularly, each of these references teaches plural wheels contacting the floor to be cleaned. The wheels drive the beater bar, obviating the need for a separate electric motor. Electric motors add cost and weight to the device. Split beater bars have also been used, as shown in 2005/0055792 and U.S. Pat. No. 7,134,161.

Many mechanical sweepers use beater bars comprising nylon bristles. Bristles may also be used on carpets, where bristles can help loosen hair. Bristles can be prone to hair/lint/thread wrapping which may degrade performance.

Since mechanical sweepers rely on momentum for pick-up, contaminated bristles reduce cleaning capability. Additionally, bristles can separate, requiring higher rotational speed to reduce bristle separation, and minimize particles passing through the bristles. Accordingly, some beater bars use fins or blades.

Powered devices may have a beater bar which is battery powered or AC line powered to aid in picking up soil. These devices have higher rotational speeds and can be more effective than mechanically driven beater bars at picking up particles. But powered devices can be inconvenient if battery life is depleted or cord length is insufficient.

Devices which also use a disposable sheet to assist in cleaning are known as illustrated by EP 1027855; US 2009/0077761; U.S. Pat. No. 7,013,528; U.S. Pat. No. 7,346,428 and commonly assigned U.S. Pat. No. 7,676,877. The disposable sheet may be attached to the implement using grippers, as described in commonly assigned application Ser. No. 13/947,501, filed Jul. 22, 2013.

Exemplary 2009/0077761 shows the common arrangement of having a sheet attached to the bottom of the device. U.S. Pat. No. 7,013,528 teaches a floor cleaner having the sheet wrap from a dust cloth panel to the top of a base assembly. But this arrangement can be inconvenient for one installing and removing the sheet, since the panel and base assembly move independently of each other. U.S. Pat. No. 7,346,428 requires the entire sheet to wrap the dusting pad 40, in order to intercept engagement members 76. This arrangement can be inconvenient as all four corners of the sheet are attached internal to the dusting pad 40. The engagement members 76 proximate to the hinges may be difficult to reach. EP 1027855 exacerbates this teaching with a removable cloth holder support 53 with two flaps 55. By being removable from the head, the support 53 can be misplaced or not properly refitted into position. Further, this arrangement does not allow for the cleaning sheet to wrap the front or back edge of the head to clean against walls/baseboards. Commonly assigned U.S. Pat. No. 7,676,877 teaches a cleaning implement having a pivotable bottom wall 455 to which a cleaning substrate may be attached. This arrangement has the pivotable wall entirely on the bottom of the device, potentially making it inconvenient to attach a sheet using ordinary grippers at the corners, as is common in the art.

Furthermore, it is not desirable to have an edge of the cleaning sheet directly on the floor. If the edge of the cleaning sheet does not wrap the device, snow-plowing of debris and/or dis-engagement of the sheet may occur.

Clearly a better approach is needed.

SUMMARY OF THE INVENTION

The invention comprises a foot which accepts a removable sheet. A handle may be pivotally attached to the foot. The foot has a housing and sole plate movable relative to each other. The sole plate may pivot relative to the housing. The sole plate has a forward portion and rearward portion opposingly disposed about a pivot. The sheet may attach to each of the forward portion and rearward portion of the sole plate.

DETAILED DESCRIPTION OF THE INVENTION

Figure 1A:
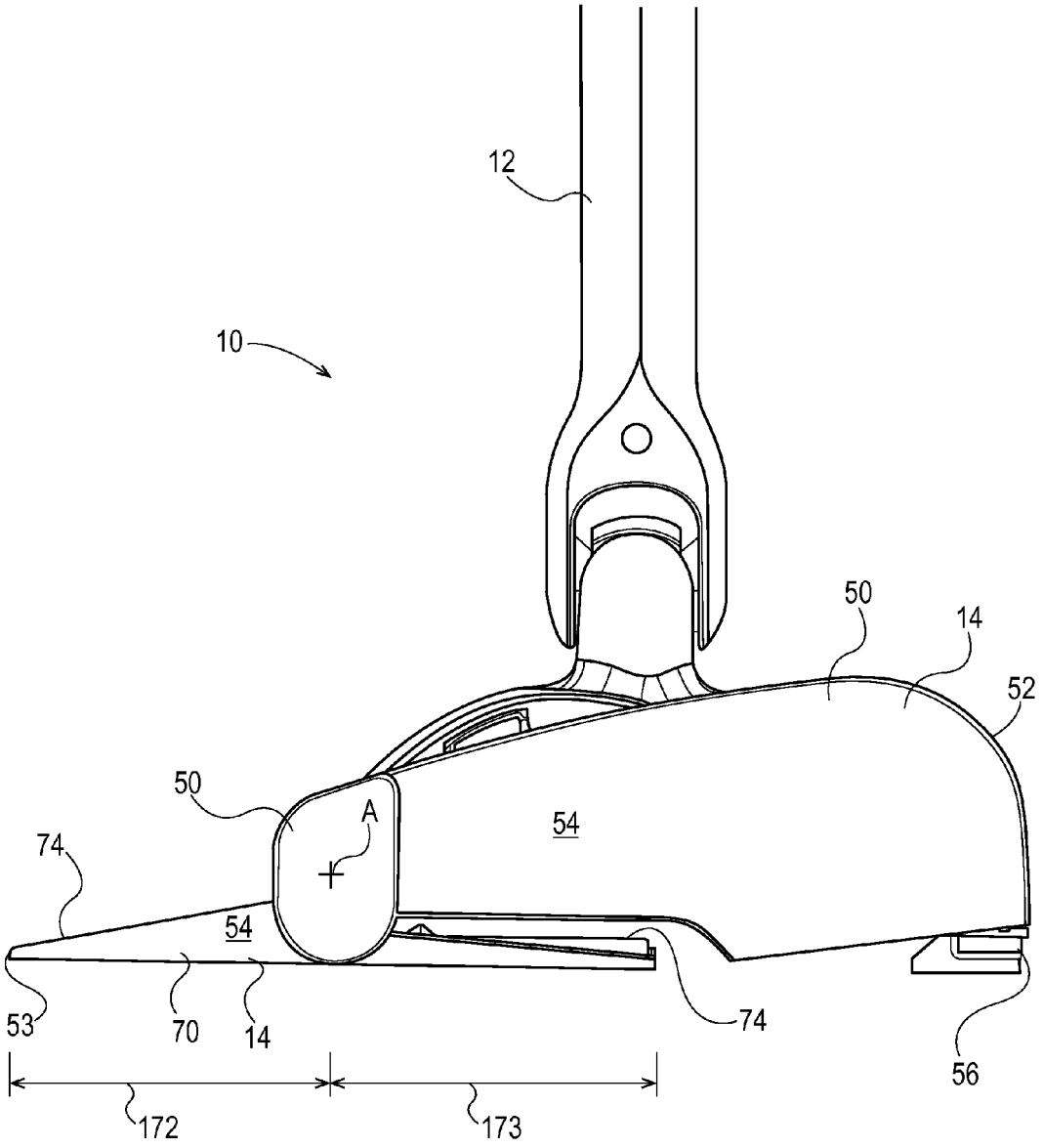
FIG. 1A is a side elevational view of a device of the present invention, with the sole plate shown in a closed position.
Figure 1B:
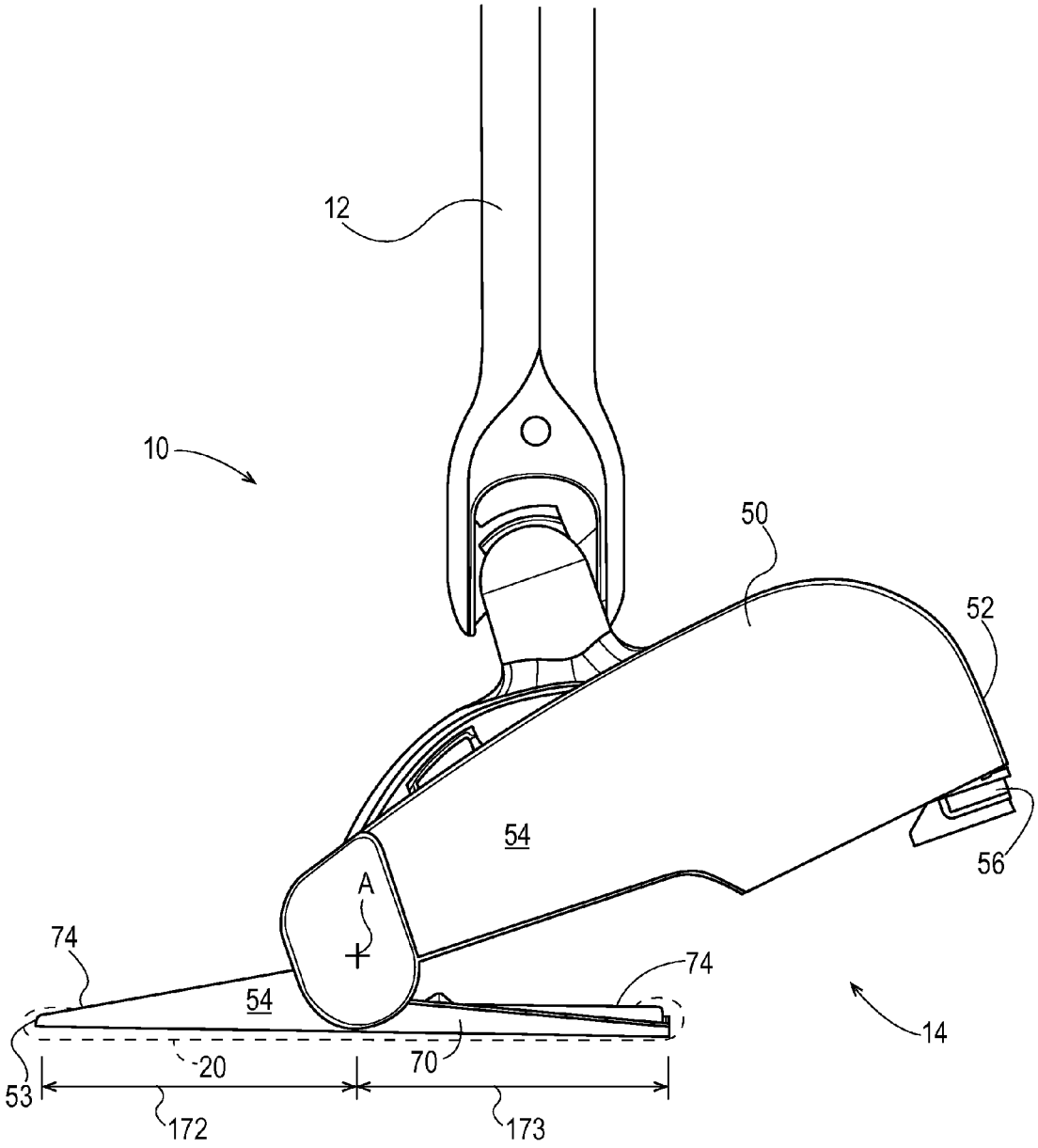
FIG. 1B is a side elevational view of the device of FIG. 1A, with the sole plate shown in an intermediate position and showing the cleaning sheet in phantom.
Figure 1C:
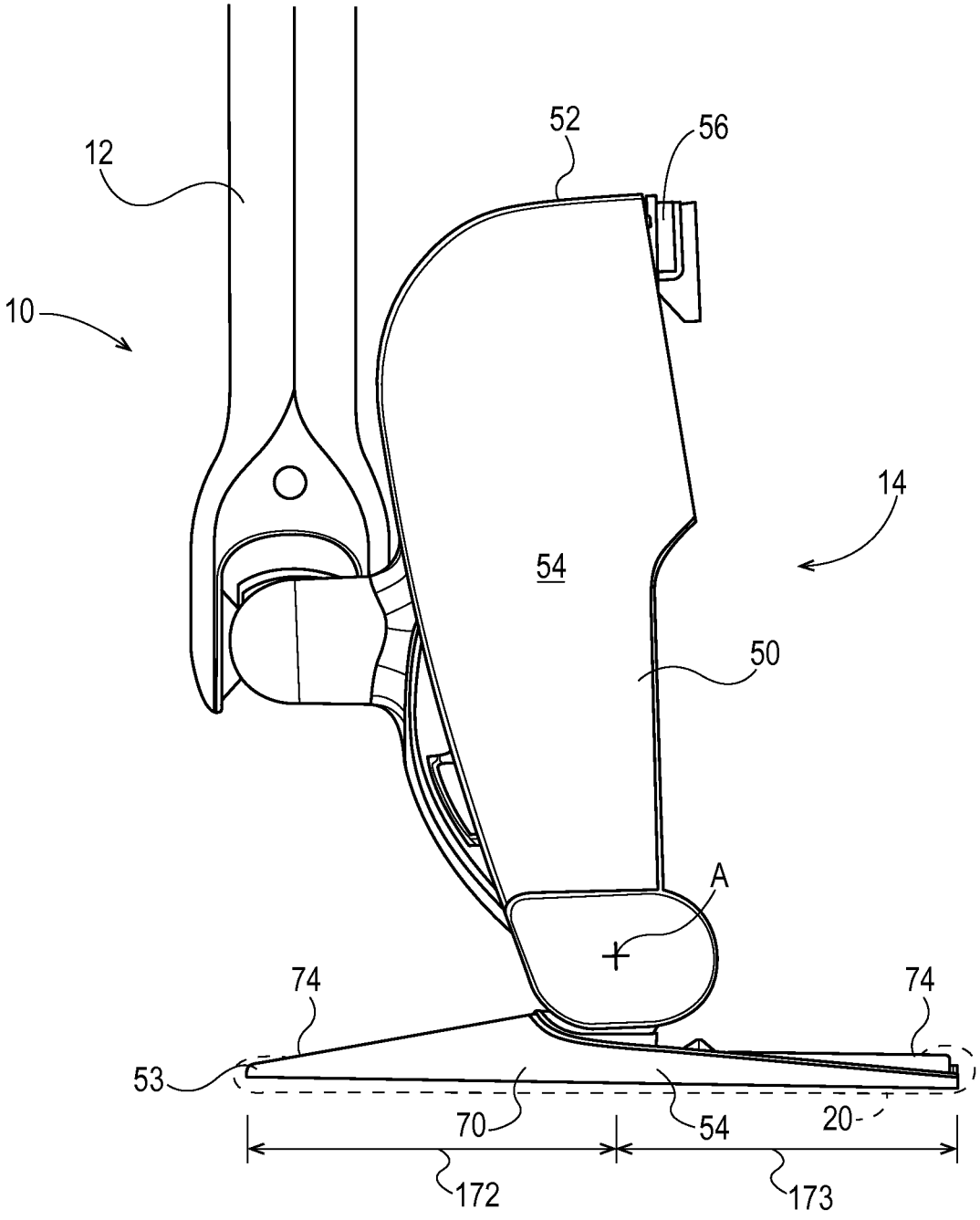
FIG. 1C is a side elevational view of the device of FIG. 1A, with the sole plate shown in a fully open position and showing the cleaning sheet in phantom.

Referring to FIGS. 1A-1C, the invention may comprise a surface cleaning device (10) for cleaning hard surfaces, such as floors, countertops, etc. The device (10) may comprise a handle (12) and a foot (14) mounted thereto in pivoting relationship. The pivoting relationship may include single axis pivoting relationship as occurs with a hinge or multi-axis pivoting relationship as occurs with a universal joint. Alternatively, if a small hand-held device (10) is desired, the handle (12) and foot (14) may be disposed in fixed relationship, so that countertops, showers and similar surfaces may be cleaned. The handle (12) and foot (14) may be permanently or removably connected together. Or a small hand held device (10) may comprise only a foot (14) and no handle (12). The foot (14) may removably receive a sheet (20) on the bottom thereof, so that such sheet (20) can slidably contact the floor or other surface during cleaning.

Referring particularly to FIGS. 1B-1C, the floor sheet (20), or other cleaning cloth, usable with the present invention may comprise a textured nonwoven and more particularly a hydroentangled nonwoven. The nonwoven may comprise a single ply having three layers. The three layers may comprise a layer of carded fibers interposed between two layers of spunbonded fibers. The sheet (20) may be made according to commonly assigned U.S. Pat. Nos. 6,561,354; 6,645,604 and/or 2002/0042962.

Optionally, the sheet (20) may comprise a laminate construction, particularly if wet cleaning is contemplated with the present invention. The laminate may comprise at least one floor contacting layer and at least one absorbent, reservoir storage layer. A third, dedicated foot (14) contacting layer is optional and can be used for attachment to the device (10). Thus, the sheet (20) of the present invention may comprise 1, 2, 3, 4 or more layers.

In one embodiment, the fibers can be an airlaid nonwoven web comprising a combination of natural fibers, staple length synthetic fibers and a latex binder. The dry fibrous web can be about 20 to 80 percent by weight wood pulp fibers, 10 to 60 percent by weight staple length polyester fibers, and about 10 to 25 percent by weight binder. The dry sheet (20) can have a basis weight between about 30 and about 1000 grams per square meter.

Pre-moistened sheets (20) used in the system of the present invention may be advantageous in that they are always ready for use, and simple to use without special dosing. The user does not have to worry about applying too much cleaning solution, leading to waste, or too little cleaning solution to be efficacious. A pre-moistened sheet (20) may be made according to the teachings of commonly assigned U.S. Pat. No. 6,716,805. The sheet (20) may comprise a perforate or imperforate film, such as is known in the art for wetted floor sheets (20). An imperforate film will inhibit, if not prevent, transmission of steam or liquid therethrough, potentially reducing efficacy of the cleaning system.

The sheet (20) may be disposable after a single use. By disposable, it is meant that the sheet (20) is discarded after a single use of cleaning at least 5, 10, 15, 20 or more square meters and is not laundered or restored. Alternatively the sheet (20) may be laundered and restored for subsequent use. The sheet (20) can function as a scrubbing material and/or have additional materials added for scrubbing.

The sheet (20) may be generally rectangular, and sized to removably fit on the sole plate (70) of the device (10). The sheet (20) may have two opposed faces, an upper face for attachment to the sole plate (70) of the device (10), and a lower face which contacts and cleans the target surface. The sheet (20) may be removably attachable to the foot (14), and particularly to the sole plate (70) thereof using grippers (74) as described herein.

Figure 2A:
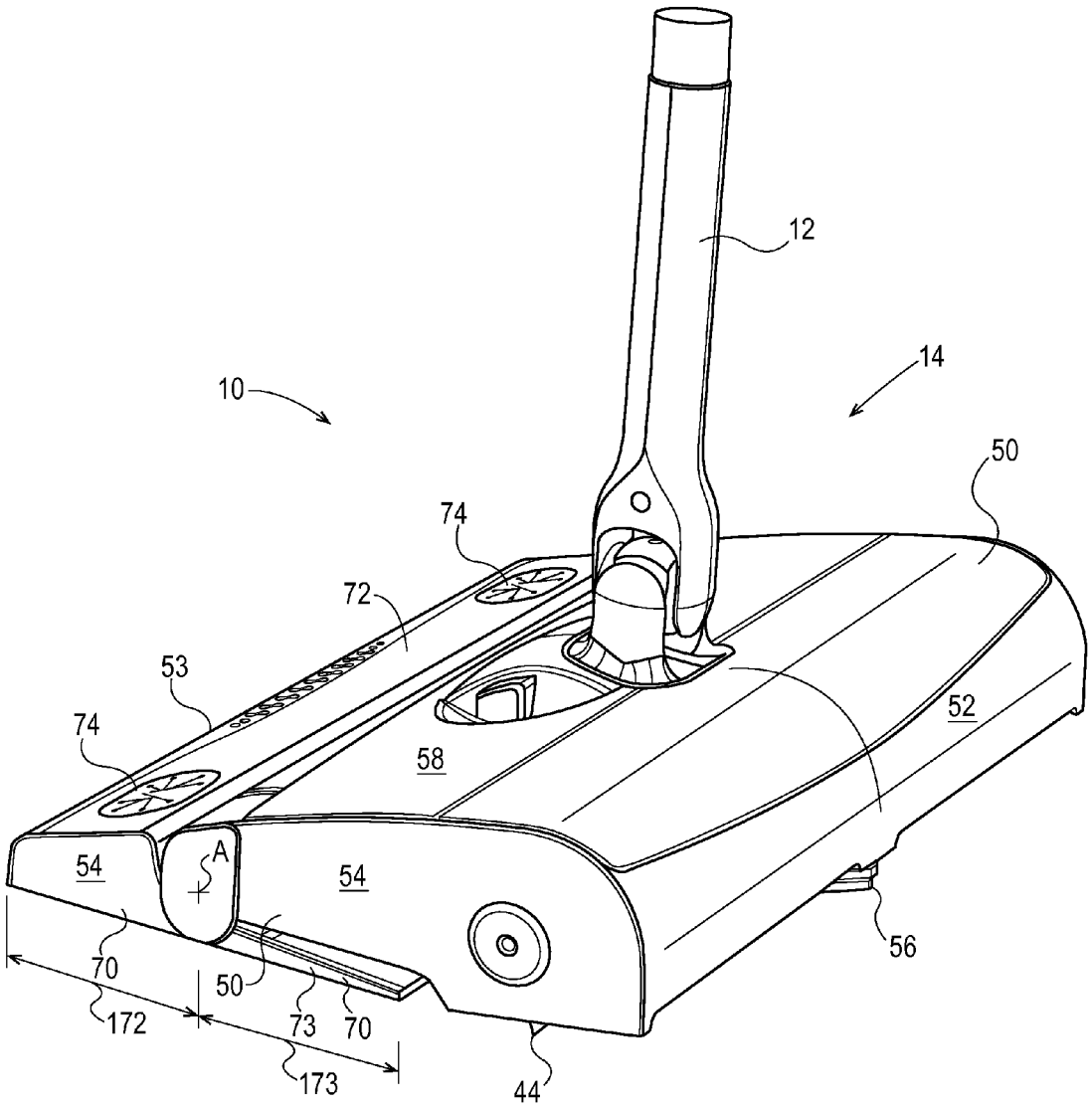
FIG. 2A is a front perspective view of an alternative embodiment of a device according to the present invention having an optional beater bar and raised head, with the sole plate shown in a closed position.
Figure 2B:
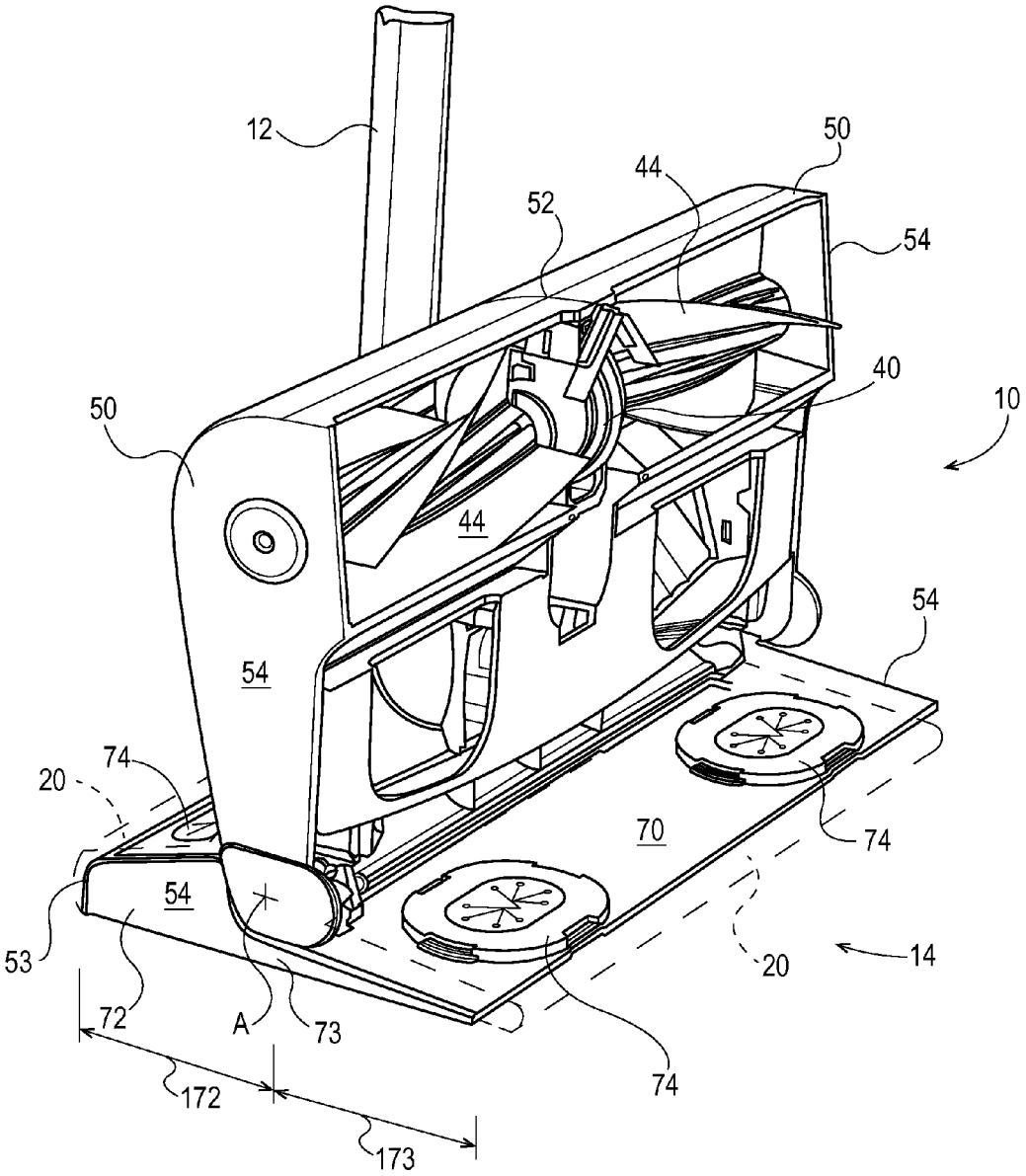
FIG. 2B is a front perspective view of the device of FIG. 2A with the sole plate shown in a fully open position and showing the cleaning sheet in phantom.
Figure 2C:
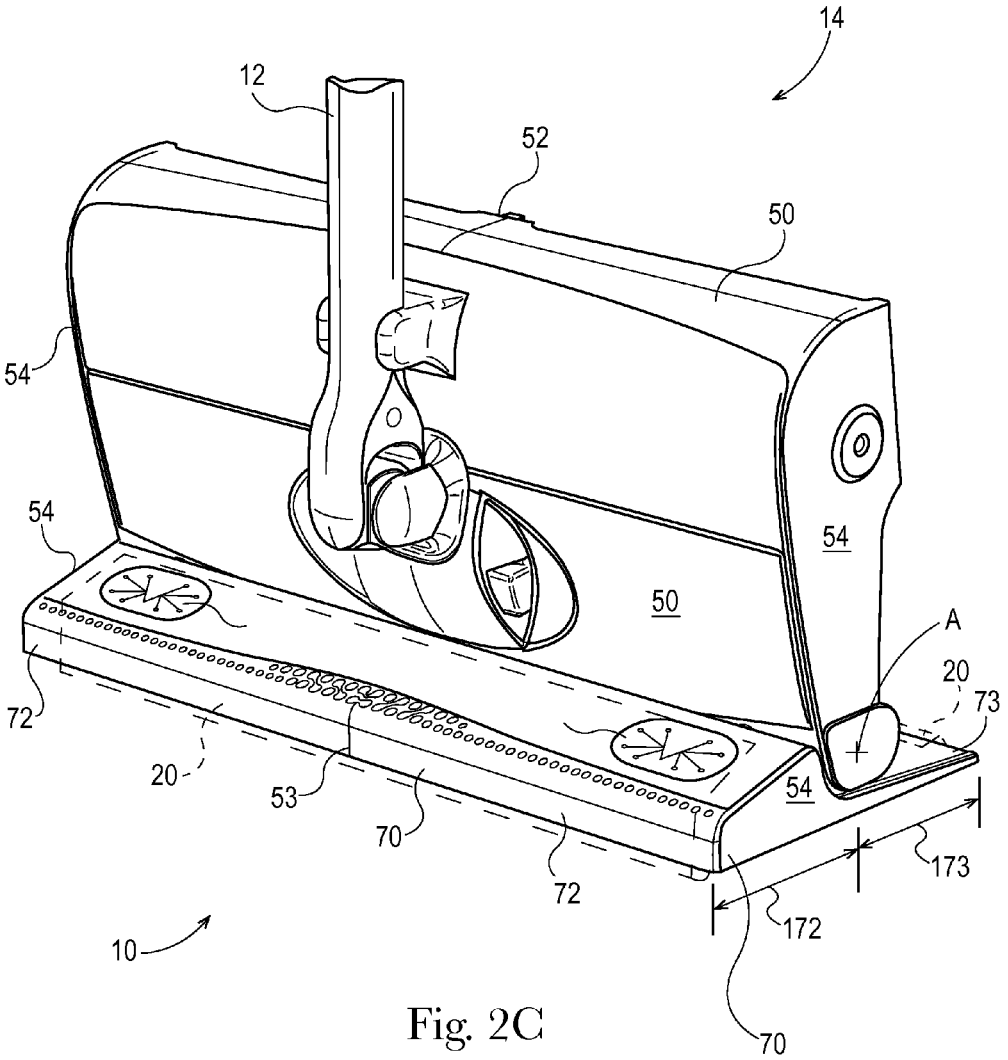
FIG. 2C is a rear perspective view of the device of FIG. 2B with the sole plate shown in a fully open position and showing the cleaning sheet in phantom.

Referring to FIGS. 2A-2C, the foot (14) may comprise a footprint large enough to accommodate the sheet (20). The foot (14) may be generally rectangular, having a front (52), rear (53) and two spaced apart sides (54). The foot (14) may comprise two mirror images, symmetrically opposite about a longitudinal centerline. The user may generally push the device (10) from front (52) to rear (53), and back, in a series of strokes.

The device (10) may optionally further comprise an axially rotatable beater bar (44), to remove debris from the floor. The beater bar (44) may be manually driven from a wheel or may be electrically powered, from an AC motor or DC motor as is known in the art. The beater bar (44) may sweep loose debris into a dirt bin (58), as described in 2010/0287716.

The optional beater bar (44) may be parallel to the widthwise direction of the foot (14) and parallel to the axle. The beater bar (44) may axially rotate about its axis on the forward stroke. Such rotation will collect large particles in an optional dirt bin (58). Smaller particles, not collected by the rotation of the beater bar (44), may be captured by the sheet (20) which trails the beater bar (44) on a forward stroke.

The beater bar (44) may be contained within a housing (50) for safety. The beater bar (44) may be parallel to the front (52)/rear (53) of the foot (14) and perpendicular to the longitudinal centerline. The device (10) may comprise two or more co-linear beater bars (44). The two beater bars (44) may be disposed with one on each side of the longitudinal centerline. Each beater bar (44) may be disposed on and rotate about an axle. Each axle may extend from the respective side (54) of the housing (50) to a trunnion juxtaposed with the longitudinal centerline. The axles may be locked in place by protrusions in the axles which fit into complementary detents in the trunnions. The beater bar (44) thus may be easily and conveniently removed and replaced, without having to undo belts, screws, etc.

Referring to FIG. 2A, the foot (14) may comprise an optional dirt bin (58). At the end of the cleaning task, or when filled, the dirt bin (58) may be removed from the foot (14) through a cover in the housing (50) or by pivoting the housing (50) to an open position. Upon removal, the dirt bin (58) may be emptied or replaced. If desired, the dirt bin (58) may comprise part of the housing (50).

Referring to FIG. 2B, the foot (14) may comprise one or more wheels (40). A single wheel (40) may be disposed on the longitudinal centerline of the foot (14) as described in commonly assigned US 2013/0333129A1. The wheel (40) may be mounted towards the front (52) or rear (53) of the foot (14). The axis and axle may be parallel to the width direction of the foot (14), and perpendicular to the longitudinal centerline of the foot (14). The wheel (40) may have a diameter ranging from 18 to 63 mm and particularly be 43 mm. The wheel (40) may be relatively narrow at the circumference, to improve maneuverability. The wheel (40) may have a rubber periphery, to provide traction sufficient to drive each optional beater bar (44), if present. The beater bar(s) (44) may be driven in a 1:1 ratio with the wheel (40) or may be geared to be rotationally driven faster than the wheel (40), at a ratio ranging to 3, 4, 5 or 6:1 or more.

Referring to FIGS. 2A-2B, the foot (14) may further comprise an optional plow (56). The plow (56) may be chevron-shaped, arcuate, diagonally oriented with respect to the front (52) of the device, etc. The plow (56) may divert debris from the wheel to more directly be intercepted by the beater bar (44) and or sheet (20).

Referring to FIGS. 1A-1C, the housing (50) may have a removable or hingedly attached sole plate (70). Removal/pivoting of the sole plate (70) from/relative to the housing (50) may allow access to the, beater bars (44), dirt bin (58) and/or particularly the sheet (20). This arrangement allows the replacement of a beater bar (44) to occur without the use of tools, such as a screwdriver or pliers. The pivoting relationship of the sole plate (70) relative to the housing (50) described herein does not require 360 degree rotation of one relative to the other. Pivoting/articulation or other temporary removal of the sole plate (16) from the housing (50), need only intercept an angle/position sufficient to allow servicing [mounting/removal] of the sheet (20) in an open position and placement of the sheet (20)/sole plate (70) in the foot (14) in the closed position for cleaning tasks.

The entire sole plate (70) may hinge to an open position. As used herein, a housing (50) and sole plate (70) may be movable relative to each other. One may be held stationary, while the other is articulated or translated to/from a closed position to an open position and back. While a sole plate (70) hingedly attached to a housing (50) is shown, one of skill will recognize the invention is not so limited.

The sole plate (70) and housing (50) may be distinguished from each other by the housing (50) generally being larger and heavier than the sole plate (70). The housing (50) may serve as a frame for and provide attachment of components such as the wheel (40), beater bar (44) dirt bin (58) and/or other components.

The sole plate (70) may pivot about a pivot axis. This axis may be perpendicular to the longitudinal centerline and extend between the two spaced apart sides (54). The sole plate (70) has a forward portion (173) and rearward portion (172) opposingly disposed about the axis. The forward portion (173) and rearward portion (172) rotate about the axis in synchronous relationship, in response to manipulation by the user. If the user grasps either the forward portion (173) or rearward portion, and manipulates one portion (172, 173) to move relative to the housing (50), the other portion (172, 173) will likewise and simultaneously move an equal amount relative to the housing (50) and around the pivot axis. The forward portion (173) and rearward portion (172) may be joined in rigid relationship, to assure synchronous movement as the sole plate (70) rotates about the pivot axis relative to the housing (50).

Each of the forward portion (173) and rearward portion (172) of the sole plate (70) may have one or more grippers (74). This arrangement allows the sheet (20) to be attached to the sole plate (70) without attachment to or interference from the housing (50). The sheet (20) may be attached to the upwardly facing surfaces of both the forward portion (173) and rearward portion (172). The grippers (74) may be disposed on the upwardly facing surfaces, oriented away from the floor, of both the forward portion (173) and rearward portion (172).

This arrangement advantageously allows the sheet (20) to wrap both the front edge of the forward portion (173) and rear edge of the rearward portion (172). By wrapping both edges of the pivotable sole plate (70), snowplowing of debris in both the forward stroke direction and reverse stroke direction is reduced. Likewise dislodging of the free edge of the sheet (20) which wraps the sole plate (70) is less likely to occur than if a free edge of the sheet (20) is disposed on the bottom of the sole plate (70) and rubs on the floor or other surface being cleaned. Such benefits are not expected or predicted in the devices known in the prior art.

The sole plate (70) may comprise a generally planar panel, having the forward portion (173) and rearward portion (172) in generally mutually coplanar relationship. Alternatively the sole plate (70) may be curved, particularly convex outwardly. This geometry provides the benefit of concentrating pressure from the user onto a smaller portion of the sheet (20) and reducing snowplowing of debris in front of the sheet (20).

One or more grippers (74) may be disposed on the head (72) of the sole plate (70). One or more grippers (74) may be disposed on the panel (73) of the sole plate (70), and particularly may be disposed on the inner face thereof, as disclosed in commonly assigned application Ser. No. 13/947,501, filed Jul. 22, 2013. This arrangement provides for all grippers (74) to be disposed on the articulable sole plate (70). In this arrangement, no grippers (74) are disposed on the housing (50).

The sheet grippers (74) may comprise resilient fingers as shown in commonly assigned U.S. Pat. Nos. 6,305,046, 6,484,346 and 6,651,290 and application Ser. No. 13/947,501 filed Jul. 22, 2013. The grippers (74) may also or alternatively comprise hook and loop fasteners, adhesive, friction grips, clamps, etc.

The grippers (74) may be exclusively disposed on the sole plate (70), as described herein. That is, the housing (50) may be free of grippers (74) and/or not require the use of grippers (74) to secure a sheet (20) to the foot (14).

This arrangement provides the benefit, not predicted by the art, the benefit that all grippers (74) can rotate together, in synchronous relationship with each other, and without relative movement between the grippers (74). Further this arrangement provides the benefit, not predicted in the art, that that the grippers (74) can be synchronously rotated together independent of the housing (50). By rotating independent of the housing (50), all grippers (74) can be accessed together in a position convenient for the user to install, remove or otherwise service the sheet (20). This arrangement prevents the housing (50) from unduly interfering with access to the grippers (74).

Referring to FIGS. 2A-2C, in a particular embodiment, the sole plate (70) may comprise a panel (73) and optional head (72) extending therefrom and particularly outwardly and/or upwardly therefrom. The head (72) may be disposed on the rearward portion (172) of the sole plate (70). The panel (73) may be disposed on or comprise the forward portion (173) of the sole plate (70).

A large portion of the panel (73) may have a generally flat shape, and be generally planar. The panel (73) may have an interior face and exterior face opposed thereto. Such panel (73) portion of the sole plate (70) need not be flat, as shown, but may have a convex or other arcuate shape, as helpful. The panel (73) may have a proximal end near the head (72) and a distal end remote therefrom. The distal end of the panel (73) may have an edge for convenient wrapping of the sheet (20) therearound.

The head (72) may be integral with and/or rigidly attached to the panel (73). This arrangement provides the benefit, not found in the art, that as the sole plate (70) is moved, such during rotated to the open/closed positions, the head (72) and panel (73) are synchronized and move together without independent movement therebetween. Synchronous, simultaneous movement of the head (72) and panel (73) provide the benefit of less manipulation of the foot (14) during sheet (20) installation/replacement.

The head (72), and rearward portion (172) in particular, may be disposed at the back of the foot (14). The sole plate (70) may partially wrap the housing (50), providing for advantageous placement of the grippers (74) on the sole plate (70). One or more grippers (74) may be disposed on the inside of the sole plate (70), and particularly the inside of the panel (73). Similarly, one or more grippers (74) may be disposed on the top of the sole plate (70), and particularly the top of the head (72).

Figure 3A:
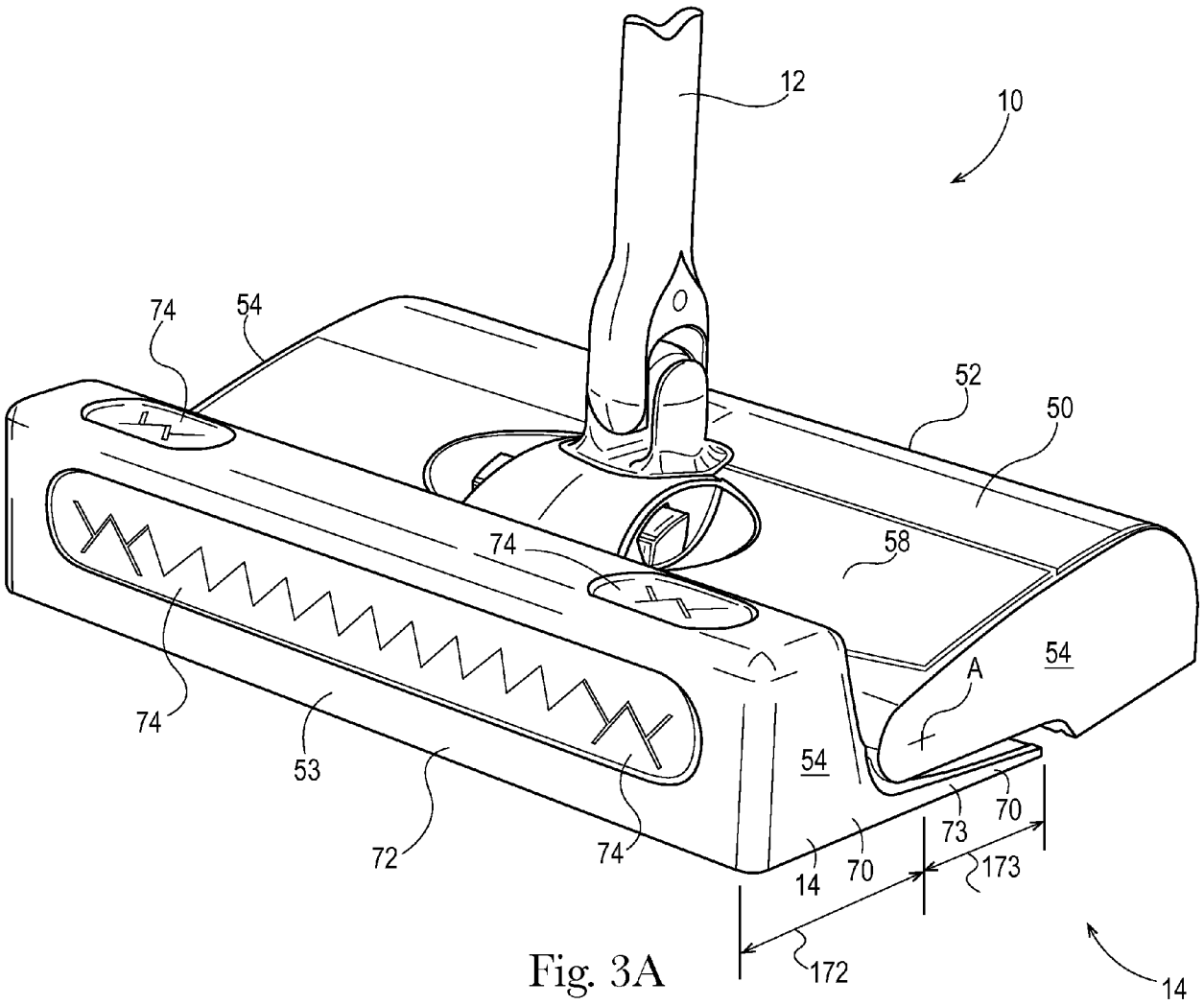
FIG. 3A is a rear perspective view of an alternative embodiment of a device according to the present invention having an optional dirt bin, dual gripper pairs to attach different cleaning sheet lengths, with the sole plate shown in a closed position.
Figure 3B:
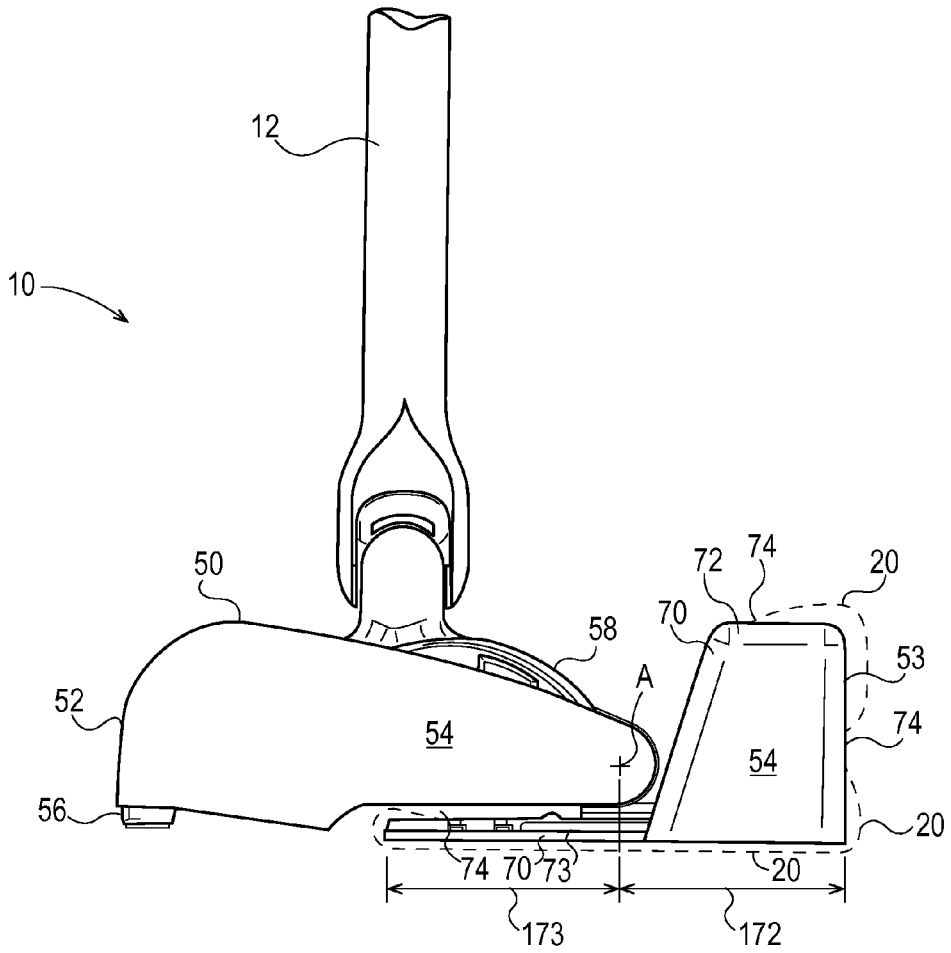
FIG. 3B is a side elevational view of the device of FIG. 3A and showing the cleaning sheet in phantom attached to two different sets of grippers.

Referring to FIGS. 3A and 3B, the head (72) may comprise grippers (74) which are disposed on the top thereof, and may be generally horizontally oriented. Alternatively or additionally, the grippers (74) may be disposed on the rear (53) of the head (72). This arrangement disposes the grippers (74) in a vertical orientation although one of skill will recognize the grippers (74) may be disposed in an orientation between vertical and horizontal.

The head (72) of FIGS. 3A and 3B has a generally vertically oriented surface. This surface provides the benefit that a portion of the sheet (20) may be vertically oriented for cleaning of baseboards, lower walls, etc. If desired, the rear (53) of the head (72) may be made of or lined with sponge, rubber, or other resiliently compliant material to conform to the profile of baseboards, molding, etc.

One of skill will recognize that the head (72) may be stationary relative to the housing (50), and still have the vertically oriented grippers (74) on the rear (53) face of the foot (14). This arrangement still provides for cleaning of baseboards, etc.

The arrangement of this invention provides the benefit, not found in the art that one end of the sheet (20) may be disposed on top of the movable sole plate (70) for convenience while the other end of the sheet (20) may wrap the distal end of the panel (73), minimizing snagging/snowplowing during use.

In a particular embodiment, two or more grippers (74) may be disposed on the top of the head (72), and two or more grippers (74) may be disposed on the inside of the panel (73). This arrangement provides the benefit that all grippers (74) move together as the sole plate (70) is rotated relative to the housing (50).

While the foot (14) is illustrated with the pivot axis near the center of the sole plate (70) and widthwise oriented, one of skill will recognize the invention is not so limited. The axis about which the sole plate (70) articulates may be parallel to the longitudinal centerline or skewed relative thereto, including being skewed relative to the horizontal plane. For example, the axis may be disposed on a side (54) of the sole plate (54). Of course, the side (54) of the sole plate (70) may be generally coplanar with the side (54) of the housing (50). Or the side (54) of the sole plate (70) may be inboard of the side (54) of the housing (50), or may be outboard thereof, so that the sole plate (70) and housing (50) have mutually different widths.

The foot (14) may further comprise a hinge, universal joint, ball and socket joint, etc. or portion thereof to pivotally receive a handle (12). Optionally and if small enough, the foot (14) may be used without a handle (12).

In yet another embodiment, the device (10) may optionally comprise a vacuum, to remove debris from the floor. The vacuum may be fan powered, and provide for delivery of lose debris to a dirt bin. The dirt bin may be mounted on the handle (12) of the device (10), as disclosed in U.S. Pat. No. 7,137,169. If a vacuum system is used, the vacuum system may have a pivoting nozzle to allow access to sheet grippers (74), as disclosed in U.S. Pat. No. 7,293,322.

In yet another embodiment, the device (10) may optionally spray the cleaning solution onto the floor or other target surface. This arrangement provides the benefit that the user can see where the cleaning solution is being applied, with it being blocked under the sheet (20). The cleaning solution may be any of the liquid solutions described above, aqueous or otherwise. The sprayer may be a pump system, as described with respect to commonly assigned U.S. Pat. No. 8,186,898, or a gravity feed system, either permanently/removably attached to the device (10) or a part thereof. Or a separate aerosol or trigger pump sprayer may be utilized, as are well known in the art. A spray system may be advantageously used with a single-use sheet (20), which is discarded after one cleaning event or with reusable sheets (20), such as microfiber sheets (20). If spray is used it will be advantageous to use dry absorbent sheets (20) such those described in commonly assigned U.S. Pat. No. 6,101,661; U.S. Pat. Nos. 7,144,173 and 7,163,349, In yet another embodiment, the device (10) may optionally apply steam to the floor. The steam may be applied through a dry sheet or a pre-wetted sheet as disclosed in commonly assigned US 2013/0319463.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

Except as otherwise noted, the articles "a," "an," and "the" mean "one or more." All documents cited in the Background and the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A foot for a cleaning device, the foot configured to receive a handle pivotally attached thereto, said foot having a longitudinal centerline, a front, a rear longitudinally opposed thereto, and two opposed sides connecting said front and said rear, and being movable on a surface, said foot comprising:

a housing, and a sole plate removably joined to said housing, said sole plate being able to removably receive a disposable cleaning sheet thereon without attachment of the cleaning sheet to said housing, said sole plate being movable about a pivot axis between an open position for servicing of the cleaning sheet and a closed position for cleaning tasks, said sole plate comprising a forward portion on one side of said pivot axis and a rearward portion oppositely on the other side of said pivot axis, each of said forward portion and said rearward portion having at least one respective gripper thereon to removably receive a respective portion of the cleaning sheet.

2. A foot according to claim 1 wherein said forward portion and said rearward portion each have an upwardly facing surface, and said grippers are disposed on said upwardly facing surface of said forward portion and said upwardly facing surface of said rearward portion.

3. A foot according to claim 1 further comprising a rotatable beater bar disposed on said foot.

4. A foot according to claim 3 wherein said beater bar is juxtaposed with said forward portion of said sole plate.

5. A foot according to claim 4 wherein said sole plate pivots about an axis juxtaposed with said rear of said housing.

6. A foot according to claim 5 wherein said axis is generally perpendicular to said longitudinal centerline.

7. A foot according to claim 6 wherein said rearward portion has a top with at least one gripper thereon and said axis is disposed below said top.

8. A foot according to claim 7 wherein said forward portion is rigidly joined to said rearward portion.

9. A device for cleaning a floor, said device having a front, a rear longitudinally opposed thereto, and two opposed sides connecting said front and said rear, and being movable on a floor, said device comprising:

an elongate handle, a foot, said foot being pivotally connected to said handle, said foot being movable on a floor, said foot having a housing and a sole plate for removably receiving a disposable floor sheet, said sole plate and said housing being articulably joined together, said sole plate comprising a head and a panel joined thereto, whereby said head protrudes from said panel, each of said head and said panel articulating in synchronous relationship with respect to said housing, each of said head and said panel having at least one gripper thereon to removably receive a portion of a cleaning sheet in said gripper.

10. A device according to claim 9 wherein said head has a top and comprises at least one gripper disposed on said top of said head.

11. A device according to claim 10 wherein said head has a head width and a head length, and said sole plate has a sole plate width and a sole plate length, said head width being substantially equal to said sole plate width.

12. A device according to claim 11 wherein said head is disposed at the rear of said foot.

13. A device according to claim 12 wherein said pivot axis is disposed between said at least one gripper on said head and said at least one said gripper on said panel.

14. A foot for cleaning a floor, said foot being movable on a floor, said foot having a front, a rear longitudinally opposed thereto, and two opposed sides connecting said front and said rear, said foot comprising:

a housing, a sole plate articulably joined to said housing and pivotable about an axis extending through said housing, said sole plate comprising a head and a panel joined thereto, whereby said head protrudes from said panel, each of said head and said panel rotating in synchronous relationship with respect to said housing from a closed position to an open position, said head having a top and a rear, at least one of said top and/or said rear of said head having at least one gripper thereon, said panel having an interior face and exterior face opposed thereto and further comprising at least one gripper being disposed on said interior face of said panel, to removably receive a cleaning sheet in said gripper for mounting to said sole plate without attaching said sheet to said housing.

15. A foot according to claim 14 having a longitudinal centerline, wherein said sole plate pivots about an axis generally perpendicular to said longitudinal centerline.

16. A foot according to claim 15 wherein said sole plate has an outwardly facing surface, said outwardly facing surface being generally planar.

17. A foot according to claim 16 wherein said sole plate has an upwardly facing surface, said upwardly facing surface being generally planar.

18. A foot according to claim 14 further comprising a sheet attached to said sole plate by said grippers, said sheet wrapping an edge of said head and wrapping an edge of said panel, when attached to said sole plate and not being attached to said housing.

* * * * *